US010456315B2

(12) United States Patent
Adimari

(10) Patent No.: US 10,456,315 B2
(45) Date of Patent: Oct. 29, 2019

(54) USER-ACTUATED DYNAMIC TENSION TRACTION APPARATUS

(71) Applicant: Innovatio Devices LLC, Murrells Inlet, SC (US)

(72) Inventor: Antonio Adimari, Myrtle Beach, SC (US)

(73) Assignee: Innovatio Devices LLC, Murrells Inlet, SC (US)

( * ) Notice: Subject to any disclaimer, the term of this patent is extended or adjusted under 35 U.S.C. 154(b) by 607 days.

(21) Appl. No.: 15/223,518

(22) Filed: Jul. 29, 2016

(65) Prior Publication Data

US 2018/0028389 A1 Feb. 1, 2018

(51) Int. Cl.
*A61H 1/02* (2006.01)

(52) U.S. Cl.
CPC ..... *A61H 1/0292* (2013.01); *A61H 1/0296* (2013.01); *A61H 2201/1611* (2013.01); *A61H 2201/1659* (2013.01); *A61H 2203/0425* (2013.01)

(58) Field of Classification Search
CPC .. A61F 5/048; A61F 5/042; A61F 5/04; A61F 5/055; A61H 1/0292; A61H 1/0218; A61H 1/022; A61H 1/0229; A61H 2203/0481; A61H 2203/0487; A61H 2203/0493; A61H 2203/0425; A61H 2201/1604; A61H 2201/1607; A61H 2201/1609; A61H 2201/1611
See application file for complete search history.

(56) References Cited

U.S. PATENT DOCUMENTS

| | | | | |
|---|---|---|---|---|
| 2,633,124 | A | 3/1953 | Yellin | |
| 2,808,049 | A | 10/1957 | Graham | |
| 3,003,498 | A | 10/1961 | Hotas | |
| 3,068,859 | A | 12/1962 | Treutelaar | |
| 3,221,735 | A | 12/1965 | Goodman | |
| 3,654,922 | A | 4/1972 | Outcalt | |
| 3,750,658 | A * | 8/1973 | Dawson, Jr. | A61H 1/0218 602/32 |
| 4,538,598 | A | 9/1985 | Rhodes et al. | |
| 4,971,043 | A | 11/1990 | Jones | |
| 5,074,287 | A | 12/1991 | Avitt | |
| 5,658,245 | A | 8/1997 | McGinnis et al. | |
| 6,113,564 | A | 9/2000 | McGuire | |
| 6,939,269 | B2 | 9/2005 | Makofsky | |
| 6,994,683 | B1 | 2/2006 | Starr | |
| 7,033,333 | B1 | 4/2006 | Croft et al. | |

(Continued)

*Primary Examiner* — Kari K Rodriquez
(74) *Attorney, Agent, or Firm* — Gregory Finch; Finch Paolino, LLC

(57) ABSTRACT

A user-actuated dynamic tension traction device is disclosed. According to various embodiments of the present disclosure, a traction device passively applies traction force to a user through the use of one or more rubber or elastic resistance bands coupled to a neck collar worn by the user. The resistance bands are anchored to a stationary surface (in a preferred embodiment a door). Traction is passively applied to the user, rather than actively, as the user moves his or her body away from the surface to which the resistance bands are anchored. As the user moves backward and stretches the resistance bands, tension is incrementally exerted by the resistance bands on the neck collar, and traction is gradually applied to the user's spine.

16 Claims, 10 Drawing Sheets

(56) References Cited

U.S. PATENT DOCUMENTS

| | | | | |
|---|---|---|---|---|
| 7,125,415 | B1 | 10/2006 | Hudgens | |
| 8,496,605 | B1 | 7/2013 | Chavers | |
| 8,657,774 | B1 | 2/2014 | Fisher | |
| 9,241,861 | B2 | 1/2016 | Bissell et al. | |
| 2009/0299248 | A1 | 12/2009 | Cha | |
| 2010/0125232 | A1 | 5/2010 | Fediaeva et al. | |
| 2013/0023931 | A1 | 1/2013 | Bovell et al. | |
| 2014/0046371 | A1* | 2/2014 | Fisher | A61H 1/0292 606/240 |
| 2014/0249461 | A1 | 9/2014 | Bissell et al. | |
| 2014/0316318 | A1 | 10/2014 | Dyer et al. | |
| 2014/0336004 | A1 | 11/2014 | Hobson et al. | |

* cited by examiner

USER-ACTUATED DYNAMIC TENSION TRACTION APPARATUS

FIELD

The present disclosure relates to the field of medical traction devices; in particular, to portable spinal decompression devices.

BACKGROUND

Spinal decompression therapy is a non-surgical, non-invasive treatment for certain types of chronic back pain that works by slowly and gently stretching the spine, taking pressure off compressed discs and vertebrae. A myriad of devices has been developed for providing decompression or applying traction to the human spine. Specifically, these devices are used to treat disc bulges, disc herniations, facet syndrome, nerve impingement, spinal/foraminal stenosis, degenerative disc disease, osteoarthritis in the spine, muscle spasm, tension headaches, decreased joint space, decreased range of motion and facet joint inflammation. Typically, the apparatus includes some type of sling or harness to cradle the head with pressure applied thereto by means of pulleys and weights, often involving fixtures to a bed or wall. Commonly, assistance from another is needed to setup the gear and monitor its use. Most of such devices, however, are complex, cumbersome, not readily portable, or require trained healthcare personnel to place the device on the patient and administer treatment. Moreover, some devices require the patient to actively apply a force or counter-force with the hands, legs or feet. This is counter to the decompression goals of getting the muscles of the patient to relax and lengthen.

A review of the prior art reveals a myriad of traction devices. For example, U.S. Pat. No. 2,808,049 issued to Graham discloses a traction device including a vertical support having a plate at a lower end for anchoring beneath a chair; at an upper end is an arm that supports a spring-biased head harness for applying traction to a user's spine.

U.S. Pat. No. 5,074,287 issued to Avitt discloses a cervical traction device including a pivoting arm having a head harness at one end and a weight stack on an opposing end. A motorized cam intermittently raises the weight stack to periodically relieve the applied traction.

U.S. Pat. No. 3,003,498 issued to Hotas discloses a spinal traction chair including a frame having a seat supported thereon. A desired amount of weight may be loaded onto a traction device to apply a desired amount of traction force to a harness.

U.S. Pat. No. 2,633,124 issued to Yellin discloses a traction apparatus including a seat having a post vertically extending therefrom. A harness at the upper end of the post is variably tensioned by a motor beneath the seat.

U.S. Pat. No. 5,658,245 issued to McGinnis et al. discloses a traction device that is attachable to a vehicle seat.

U.S. Pat. No. 3,068,859 issued to Treutelaar discloses a therapeutic traction device comprising a base frame having a shaft vertically extending therefrom; a spring-biased tensioning cord and associated head harness are secured to an upper end of the shaft.

U.S. Pat. No. 9,241,861 issued to Bissell et al. discloses a portable traction device having a tensioning control which is incrementally adjustable in both tightening and slackening and which indexes positions smoothly.

U.S. Pat. No. 8,496,605 issued to Chavers discloses a therapeutic traction device comprising a tensioning mechanism that includes a telescoping, pneumatic cylinder that is extended with a compressible bulb. The cylinder engages a pivotal lever that pulls the cable downwardly when the cylinder is extended, thereby applying tension to a harness.

Numerous additional prior art solutions for spinal traction devices exist in the art. However, all prior art devices apply functionally equivalent biomechanical force to the user's spine. Traction force in all prior art traction devices is applied linearly in a single vector, opposite the resistance means. Traction force in prior art devices is generally applied either with the use of cables and weights (such as U.S. Pat. No. 5,658,245 to McGinnis et al.) or the use of inflatable tensioning systems (such as U.S. Pat. No. 8,496,605 to Chavers). Some prior art solutions have attempted to create user-actuated dynamic traction (such as U.S. Pat. No. 9,241,861 to Bissell et al.); however, these solutions still apply traction force to the user in a linear direction. These prior art solutions fail to provide the optimal biomechanical traction force to the user for spinal decompression therapy. Active force against the neck of the user invokes a negative feedback response causing muscles in the user's neck to tighten. This is counter to the decompression goals of getting the muscles of the patient to relax and lengthen. In addition, the linear direction of the force does not provide the optimal resistance to relax and lengthen the patients muscles in his or her or her natural range of motion. For optimally effective spinal decompression, the muscles should be able to be engaged in the full range of motion of the neck.

Through applied effort, ingenuity, and innovation, Applicant has identified a number of deficiencies and problems with spinal traction devices. Applicant has developed a solution that is embodied by the present invention, which is described in detail below.

SUMMARY

The following presents a simplified summary of some embodiments of the invention in order to provide a basic understanding of the present disclosure. This summary is not an extensive overview of the present disclosure. It is not intended to identify key/critical elements of the invention or to delineate the scope of the invention. Its sole purpose is to present some embodiments of the invention in a simplified form as a prelude to the more detailed description that is presented later.

An object of the present disclosure is to provide a traction device for spinal decompression therapy that is operable to counter act the body's natural reflex to tense the muscles in the neck in response to traction force.

Another object of the present disclosure is to provide a traction device for spinal decompression therapy that enables variable direction and variable change in tension pressure in the traction vector.

Yet another object of the present disclosure is to provide a traction device for spinal decompression therapy that utilizes active traction force in response to the body position of the user.

Specific embodiments of the present disclosure include a portable apparatus for spinal decompression therapy, comprising a first frame assembly, the first frame assembly having an attachment means configured to selectively couple to a bottom portion of a door; a second frame assembly, the second frame assembly having an attachment means configured to selectively couple to a top portion of a door; at least one first resistance band having a first end and a second end, the first end of the at least one first resistance band being removably coupled to a right-side portion of the first frame assembly, and the second end of the at least one first resistance band being removably coupled to a right-side portion of the second frame assembly; at least one second resistance band having a first end and a second end, the first end of the at least one second resistance band being removably coupled to a left-side portion of the first support frame, and the second end of the at least one first resistance band being removably coupled to a left-side portion of the second support frame; and, a neck collar having a first attachment means selectively attached to the at least one first resistance band, and a second attachment means selectively attached to the at least one second resistance band, the collar being configured to be selectively coupled around the head of a user.

Specific embodiments of the present disclosure may further include a portable apparatus for spinal decompression therapy, comprising a first frame assembly, the first frame assembly having an attachment means configured to selectively couple to a bottom portion of a door; a second frame assembly, the second frame assembly having an attachment means configured to selectively couple to a top portion of a door; a first support arm pivotably coupled to the second frame assembly; a second support arm pivotably coupled to the second frame assembly; at least one first resistance band having a first end and a second end, the first end of the at least one first resistance band being removably coupled to a right-side portion of the first frame assembly, and the second end of the at least one first resistance band being removably coupled to a right-side portion of the second frame assembly and the first frame assembly; at least one second resistance band having a first end and a second end, the first end of the at least one second resistance band being removably coupled to a left-side portion of the first frame assembly, and the second end of the at least one first resistance band being removably coupled to a left-side portion of the second frame assembly and the second support arm; and, a collar having a first cable selectively attached to the at least one first resistance band, and a second cable selectively attached to the at least one second resistance band, the collar being configured to be selectively coupled to the neck of a user.

Specific embodiments of the present disclosure may further include an apparatus for spinal decompression therapy, comprising a means for anchoring two or more resistance cables; two or more resistance cables selectively coupled to the anchoring means, the two or more resistance cables being coupled to the anchoring means and spaced apart from each other in the range of about eight inches to about 36 inches; and, a collar having a first attachment means and a second attachment means selectively attached to the two or more resistance cables, the collar being configured to be selectively coupled around the head of a user.

The foregoing has outlined rather broadly the more pertinent and important features of the present invention so that the detailed description of the invention that follows may be better understood and so that the present contribution to the art can be more fully appreciated. Additional features of the invention will be described hereinafter which form the subject of the claims of the invention. It should be appreciated by those skilled in the art that the conception and the disclosed specific methods and structures may be readily utilized as a basis for modifying or designing other structures for carrying out the same purposes of the present invention. It should be realized by those skilled in the art that such equivalent structures do not depart from the spirit and scope of the invention as set forth in the appended claims.

BRIEF DESCRIPTION OF DRAWINGS

The above and other objects, features and advantages of the present disclosure will be more apparent from the following detailed description taken in conjunction with the accompanying drawings, in which.

DETAILED DESCRIPTION

Figure 1A:
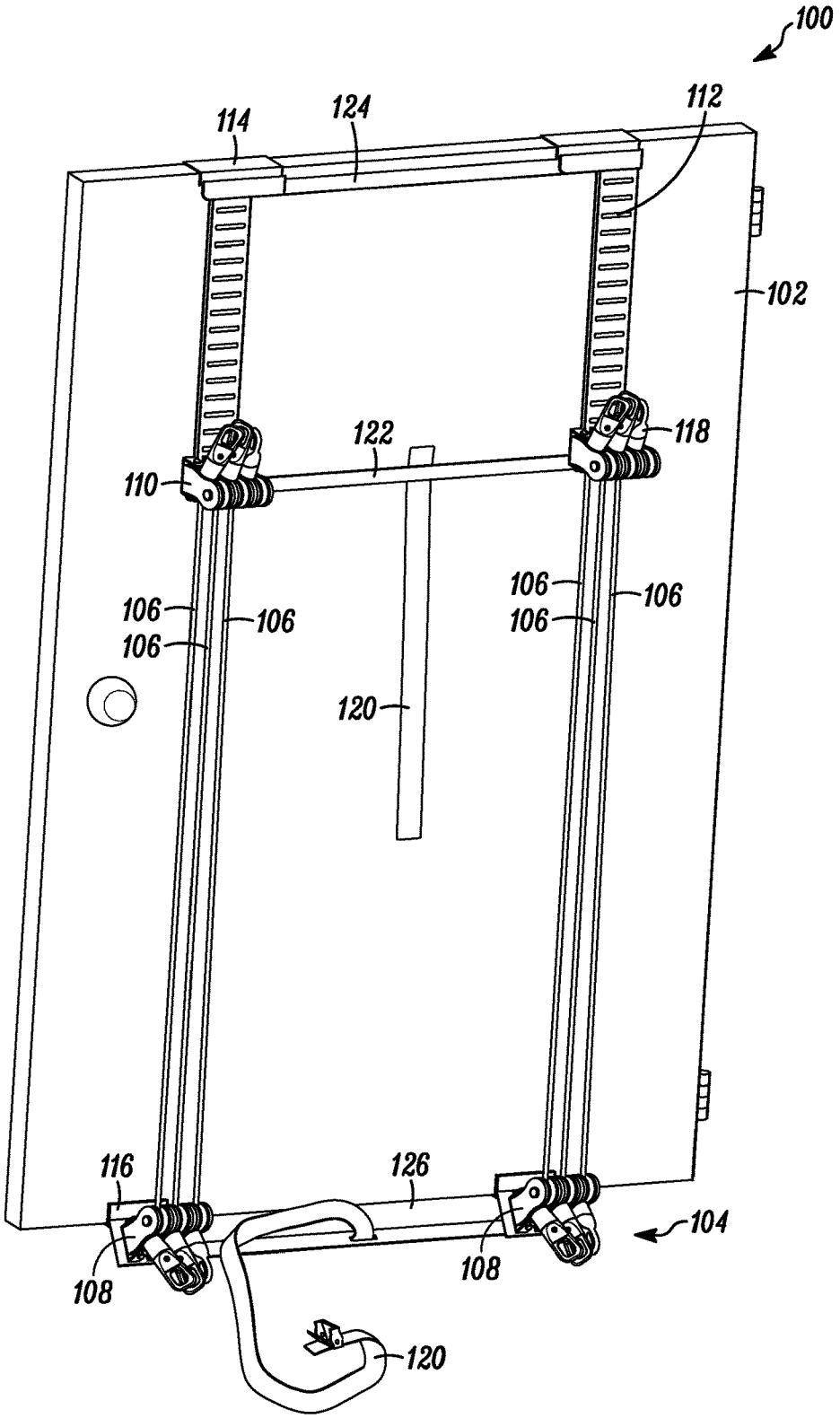
FIG. 1A is a perspective view of a dynamic tension traction device, according to an embodiment of the present disclosure.

Exemplary embodiments are described herein to provide a detailed description of the present disclosure. Variations of these embodiments will be apparent to those of skill in the art. Moreover, certain terminology is used in the following description for convenience only and is not limiting. For example, the words "right," "left," "top," "bottom," "upper," "lower," "inner" and "outer" designate directions in the drawings to which reference is made. The word "a" is defined to mean "at least one." The terminology includes the words above specifically mentioned, derivatives thereof, and words of similar import.

Embodiments of the present disclosure provide for a dynamic tension traction apparatus for spinal decompression therapy. Embodiments of the present disclosure solve problems associated with prior art traction devices that apply traction force using static deadweight, and prior art traction devices that apply traction in a single force vector. Prior art traction devices apply force actively on the neck of the user either through use of a counter weight, user-actuated cables and pulleys, or inflatable neck braces or tensioning mechanisms. The application of active force on the neck triggers the human body's natural reflect to tense the muscles in the neck to protect the spine. Applying traction in this manner leads to chronic neck spasms, muscle pain, and headaches.

Another problem with prior art traction devices is these devices apply traction in a single, linear force vector. The application of traction in a single vector is often not the most effective means of administering spinal decompression therapy. Compression or herniation of spinal discs is often asymmetrical, which may be more effectively relieved by applying traction in a multitude of force vectors. In addition, muscle pain associated with spinal injury is most effectively alleviated by relaxing and lengthening the muscles on each side of the neck. If force is applied in a single traction vector, the muscles of the neck cannot be isolated and relaxed.

Embodiments of the present disclosure seek to overcome the deficiencies in the prior art, and provide a more effective traction apparatus. Specific embodiments provide for a portable apparatus that enables the user to self-administer spinal decompression in a home setting. According to various embodiments of the present disclosure, the problem of reflex tension in the neck during traction is solved by passively applying traction using one or more rubber or elastic resistance bands coupled to a neck collar worn by a user. The resistance bands are anchored to a stationary surface (in a preferred embodiment a door). Traction is passively applied to the user, rather than actively, as the user moves his or her body away from the surface to which the tension bands are anchored. As the user moves backward and stretches the resistance bands, tension is incrementally exerted by the resistance bands on the neck collar, and traction is gradually applied to the user's spine. The user is able to move against the reflex of the tightening of the muscles in the neck by gradually moving their body into the traction force. Since tension is gradually applied by the resistance bands in response to the user's body movement, the user is able to apply the desired amount of traction force simply by repositioning his or her body. The user can immediately reduce or increase the amount of traction according to body position. Additional resistance bands may be coupled to the neck collar to increase the maximum traction force that may be applied by the device.

According to various embodiments of the present disclosure, the problem of traction being applied in a single force vector is solved by coupling one or more resistance bands (as described above) on opposite sides of the neck collar, and anchoring the resistance bands approximately shoulder-width apart (in a preferred embodiment in the range of about 20 inches to about 30 inches) on the stationary surface. By coupling the resistance bands to either side of the neck collar, the resistance bands are able to exert force in a multitude of vectors across the x-, y- and z-axes, depending on the position of the user. The user can alter the direction of the traction vector by repositioning his or her body upward, downward, backward, forward, and side-to-side.

Referring now to FIG. 1A, a perspective view of a dynamic tension traction device 100 is shown. According to an embodiment, device 100 is generally comprised of an upper frame assembly 102, a lower frame assembly 104, and at least two resistance bands 106. Resistance bands 106 may be made from elastic, rubber, or another non-deformable, stretchable material.

Resistance bands 106 are removably coupled to upper frame assembly 102 and lower frame assembly 104, and extend from lower frame assembly 104 to upper frame assembly 102 on a left side and a right side. Upper frame assembly 102 and lower frame assembly 104 may be approximately 20 inches to 30 inches in width, such that device 100 fits within a standard size door frame. It is anticipated upper frame assembly 102 and lower frame assembly 104 may be wider or narrower in width for certain embodiments. Lower frame assembly 104 is generally comprised of lower rollers 108, a lower bracket support bar 126, and a lower bracket 116. Upper frame assembly 102 is generally comprised of upper rollers 110, roller tracks 112, upper brackets 114, upper roller support bar 122, and upper bracket support bar 124. According to a preferred embodiment, device 100 is removably connected to a door 10. A user connects device 100 to door 10 by placing lower brackets 116 around the bottom portion of the door, and upper brackets 114 around a top portion of the door. Resistance bands 106 are stretched between lower frame assembly 104 and upper frame assembly 102, and friction fit lower brackets 116 and and upper brackets 114 on the door. Device 100 is removed from door 10 by pulling upward on upper bracket 114 and disengaging it from door 10. The tension on resistance bands 106 is thereby relieved, and lower brackets 116 can be disengaged from the lower portion of door 10. Device 100 can thereby be stored or transported for future use. Storage strap 120 is used selectively bundle lower frame assembly 104, upper frame assembly 102, and resistance bands 106 for more convenient storage or transport.

Figure 1B:
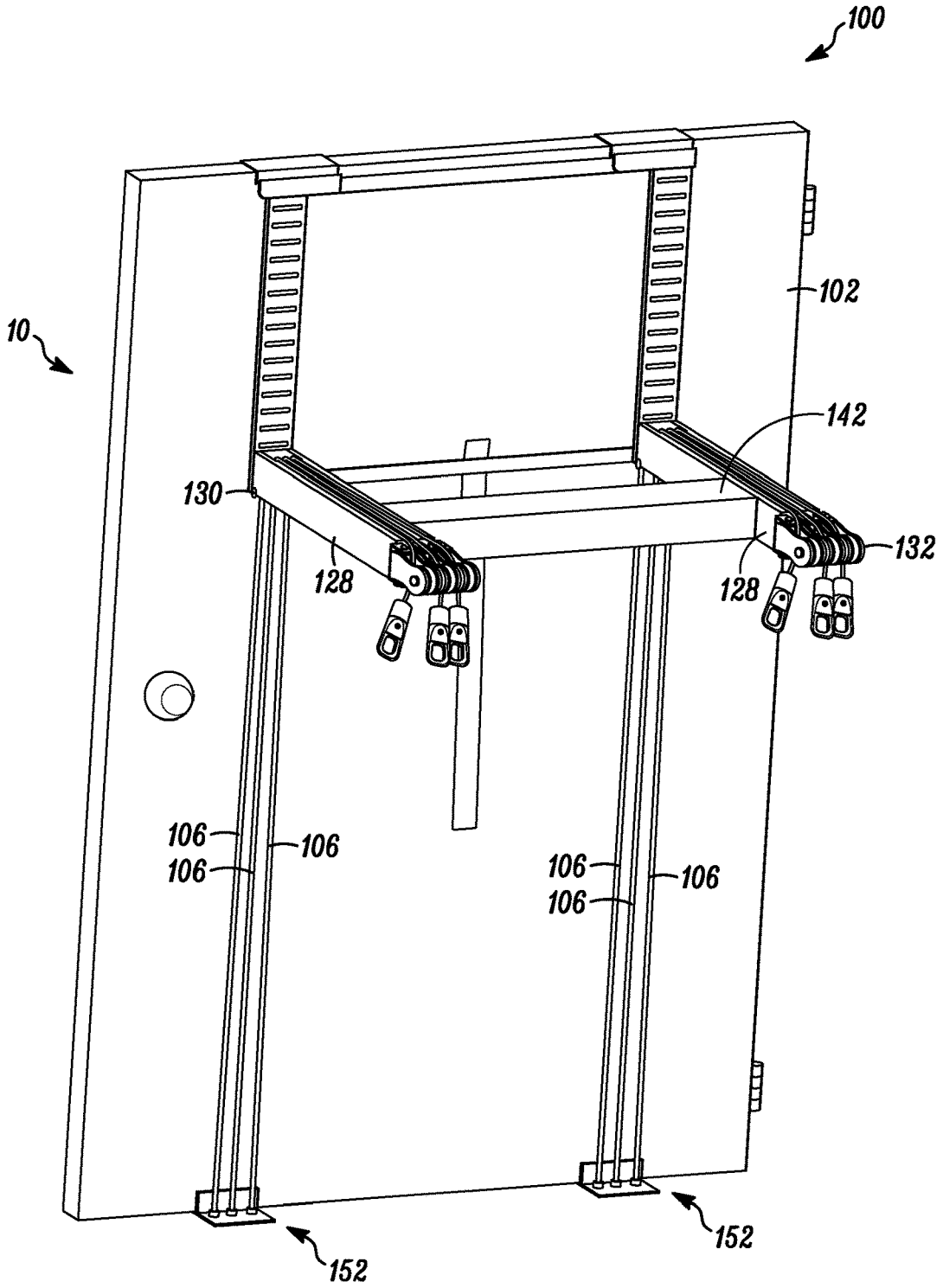
FIG. 1B is a perspective view of a dynamic tension traction device, according to an embodiment of the present disclosure.

Referring now to FIG. 1B, a perspective view of dynamic tension traction device 100 is shown. As described in FIG. 1A, device 100 is generally comprised of upper frame assembly 102, anchor bracket 152, and at least two resistance bands 106. According to an embodiment, device 100 may further comprise extension arms 128. Extension arms 128 are coupled to upper frame assembly 102 via extension arm bracket 130. Extension arm bracket 130 may comprise a hinge configured to selectively position extension arms 128 from an extended position (as shown in FIG. 1B) to a collapsed position. Extension arms 128 may further include extension arm rollers 132. An extension arm support rod 142 may extend between extension arms 128 to provide strength and structural integrity to extension arms 128 during use. Resistance bands 106 extend from lower frame assembly 104 to extension arms 128 and are coupled to extension arm rollers 132. Extension arms 128 extend the position of tension bands 106 away from the door such that a user can position his or her body away from the door during use. In this embodiment, lower bracket 152 is different than lower frame assembly 104 from FIG. 1A. Anchor bracket 152 does not include lower rollers, and is comprised of a door bracket and anchor point for resistance bands 106.

Figure 2:
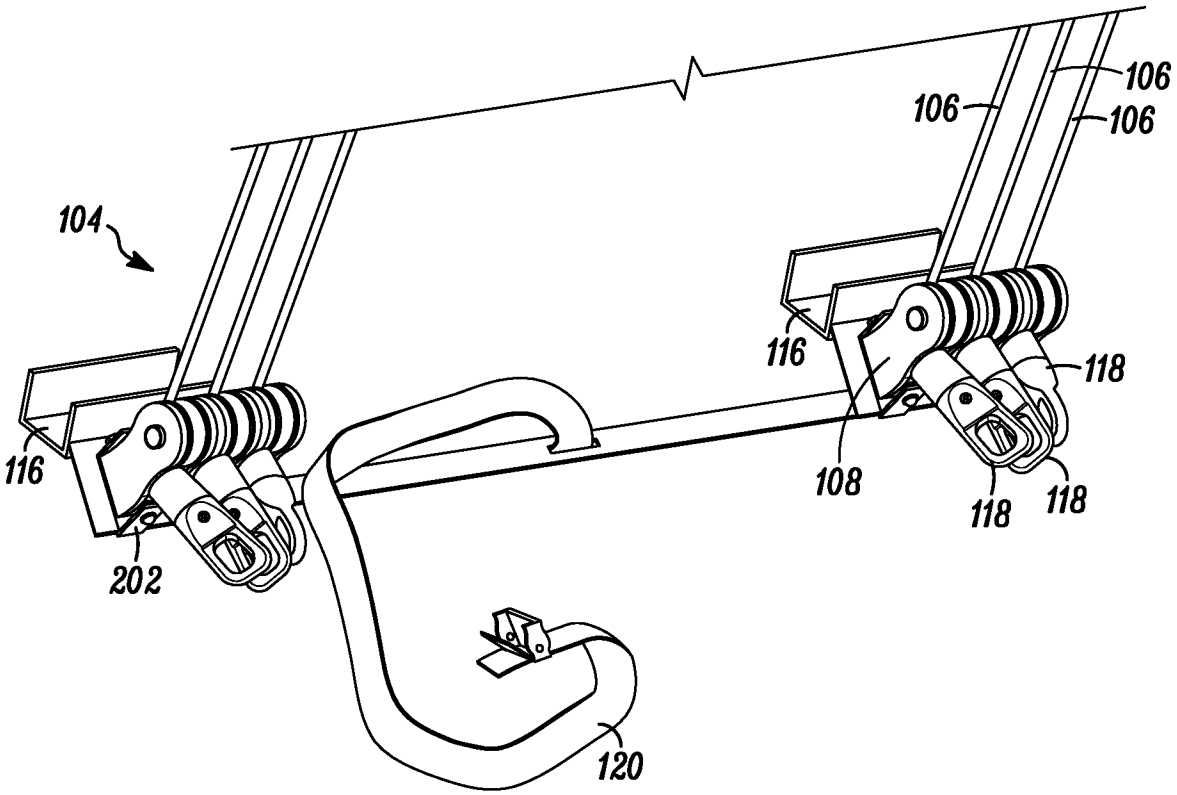
FIG. 2 is a perspective view of a lower bracket of a dynamic tension traction device, according to an embodiment of the present disclosure.

FIG. 2 is a perspective view of lower frame assembly 104 of dynamic tension traction device 100. FIG. 2 illustrates lower frame assembly 104 when disconnected from a door. Lower frame assembly 104 may be disconnected from a door when not in use, such as for storage and transport. Lower brackets 116 are shown in more detail in FIG. 2. Lower brackets 116 are substantially U-shaped such that the bottom portion of a door can be received by lower brackets 116. Lower brackets 116 are approximately two inches in width and two inches in depth to accommodate the width of a standard size door; however, lower brackets 116 may be any width to accommodate various size doors. Alternatively, lower brackets 116 may be adjustable in certain embodiments by utilizing a clamping mechanism, screw, or other means to couple to the bottom portion of a door or other stationary surface. Structural support for lower brackets 116 is provided by lower bracket support bar 122. Lower brackets 116 and lower bracket support bar 122 may be constructed from steel, aluminum, or other commercially reasonable metal or metal alloy. Lower rollers 108 are coupled to lower brackets 116 using lower roller brackets 202. Lower rollers 108 are configured to roll about an axle, and have a recessed track in which resistance bands 106 maintain contact with lower rollers 108. Resistance band connectors 118 enable resistance bands 106 to maintain contact with lower rollers 108 as tension is applied to resistance bands 106 during use.

Figure 3:
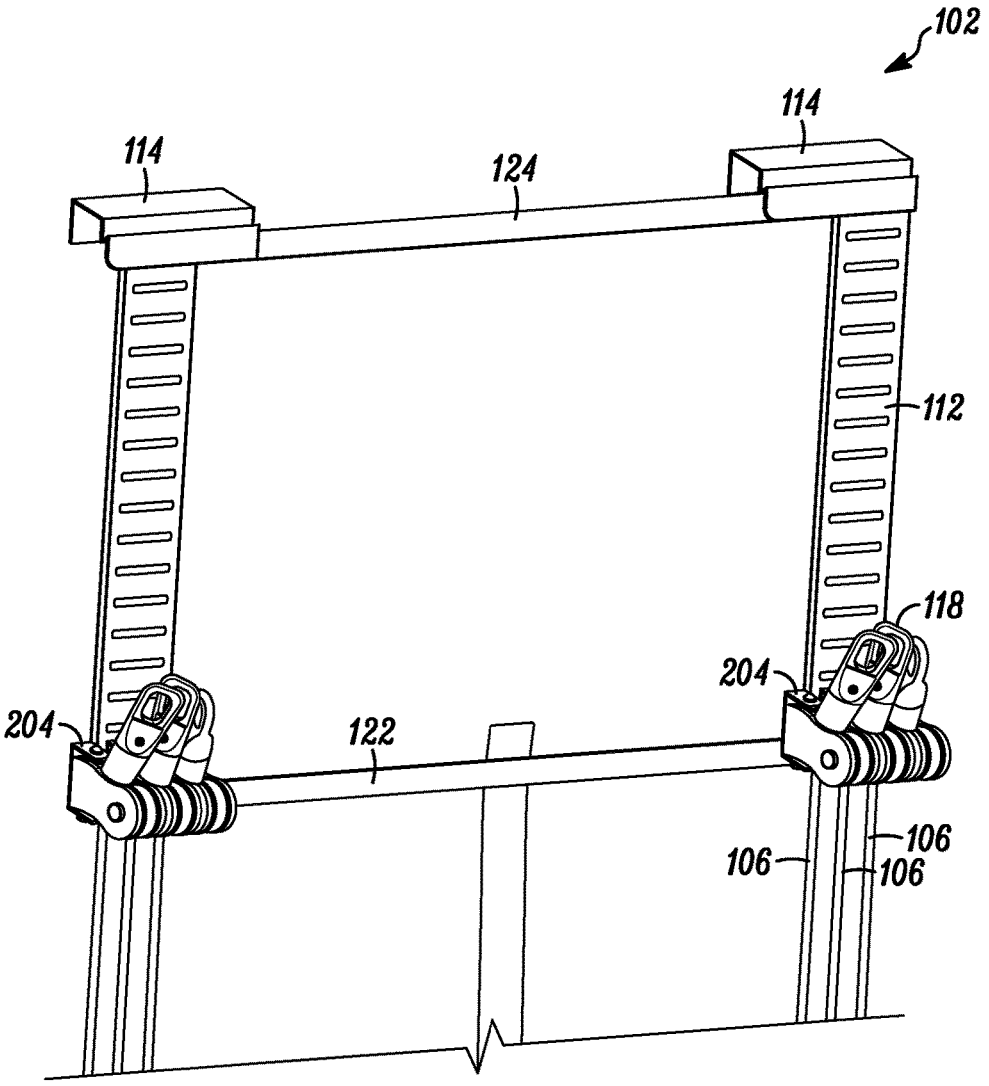
FIG. 3 is a perspective view of an upper bracket of a dynamic tension traction device, according to an embodiment of the present disclosure.

FIG. 3 is a perspective view of upper frame assembly 102 of dynamic tension traction device 100. FIG. 2 illustrates upper frame assembly 102 when disconnected from a door. Upper frame assembly 104 may be disconnected from the door when not in use, such as for storage and transport. Upper brackets 114 are shown in more detail in FIG. 3. Upper brackets 116 are substantially U-shaped such that the top portion of a door can be received by upper brackets 114. Upper brackets 114 are approximately two inches in width and two inches in depth to accommodate the width of a standard size door; however, upper brackets 114 may be configured in any width to accommodate various size doors. Alternatively, upper brackets 114 may be adjustable in embodiments that might utilize a clamping mechanism, screw, or other means to couple to the bottom portion of a door or other stationary surface. Structural support for upper brackets 114 is provided by upper bracket support bar 124. Upper brackets 114 and upper bracket support bar 124 may be constructed from steel, aluminum, or other commercially reasonable metal or metal alloy. Roller track 112 may be coupled to upper brackets 114, upper bracket support bar 124, and roller support bar 122 to define the structure of upper frame assembly 102. Upper rollers 110 are coupled to upper roller bracket 204, which is coupled to to roller track 112. Roller track 112 may have a plurality of slotted apertures in which upper roller bracket 204 may be selectively coupled. Upper roller bracket 204 is selectively coupled to a selected aperture on roller track 112 according to the desired height of upper rollers 110 when in use. Upper rollers 110 are configured to roll about an axle, and have a recessed track in which resistance bands 106 maintain contact with upper rollers 110. Resistance band connectors 118 enable resistance bands 106 to maintain contact with upper rollers 110 as tension is applied to resistance bands 106 when device 100 is attached to a door.

Figure 4:
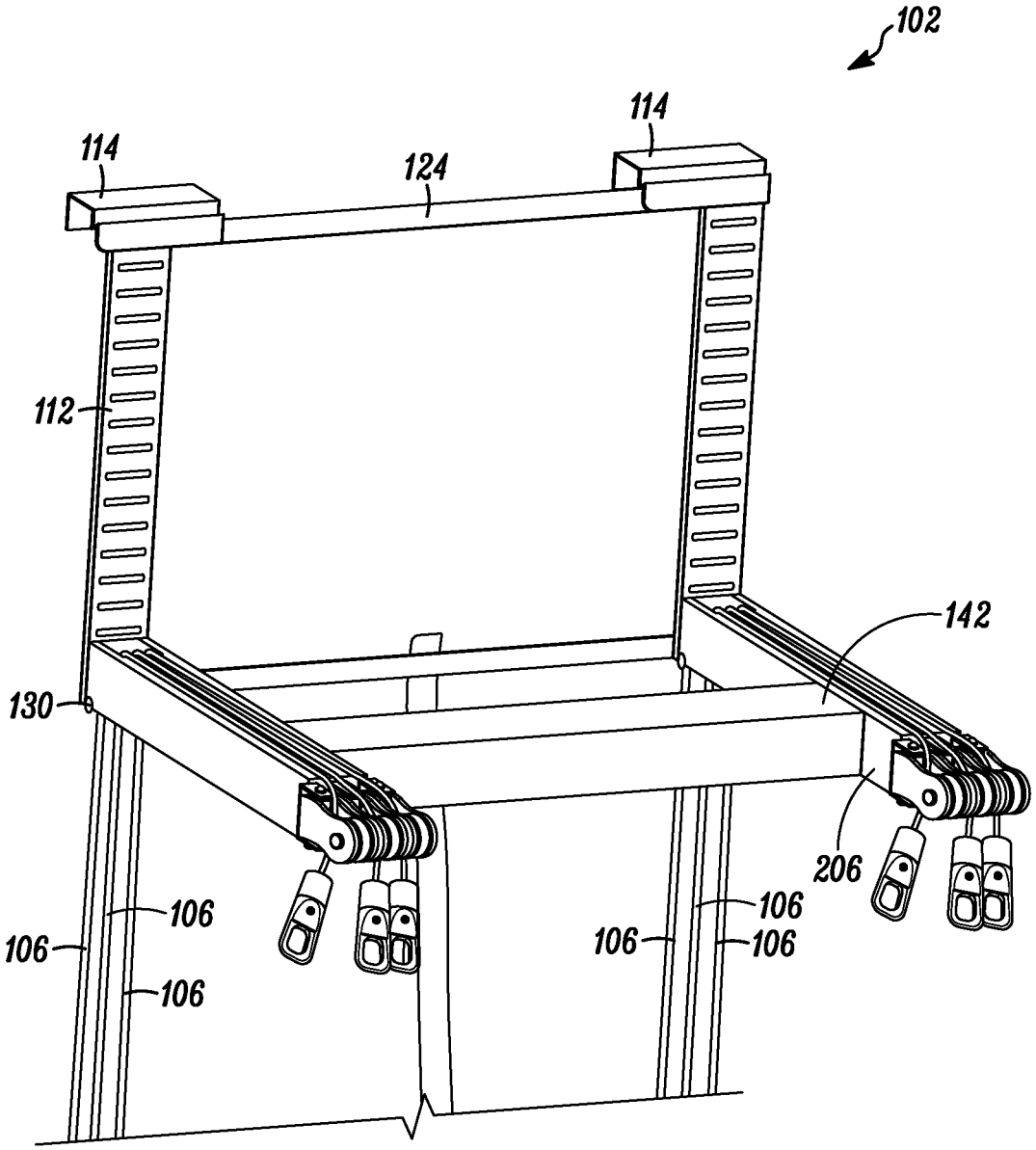
FIG. 4 is a perspective view of an upper bracket of a dynamic tension traction device, according to an embodiment of the present disclosure.

FIG. 4 is a perspective view of an upper bracket of a dynamic tension traction device 100. According to an embodiment of the present disclosure, extension arms 128 are coupled to extension arm hinge 130. Extension arm bracket 130 may include a hinge configured to selectively position extension arms 128 from an extended position (as shown in FIG. 4) to a collapsed position. Extension arm support rod 142 extends between extension arms 128 to provide strength and structural integrity to extension arms 128 during use. Extension arm bracket 130 is coupled to roller track 112. Extension arms 128 may further include extension arm roller bracket 206 and extension arm rollers 132. Resistance bands 106 extend from lower frame assembly 104 (as shown in FIG. 1A) or anchor bracket 152 (as shown in FIG. 1B), through extension arm bracket 130 and along the length of extension arms 128, and are threaded through extension arm roller bracket 206 and are engaged with extension arm rollers 132. Extension arms 128 extend the position of resistance bands 106 away from the door such that a user can position his or her body away from the door during use. Roller track 112 may have a plurality of slotted apertures in which extension arm bracket 130 may be selectively coupled. Extension arm bracket 130 is selectively coupled to a selected aperture on roller track 112 according to the desired height of extension arms 128 when in use. Extension arm rollers 132 are configured to roll about an axle, and have a recessed track in which resistance bands 106 are configured to fit within extension arms 128. Resistance band connectors 118 enable resistance bands 106 to maintain contact with extension arms 128 as tension is applied to resistance bands 106 when device 100 is attached to a door.

Figure 5:
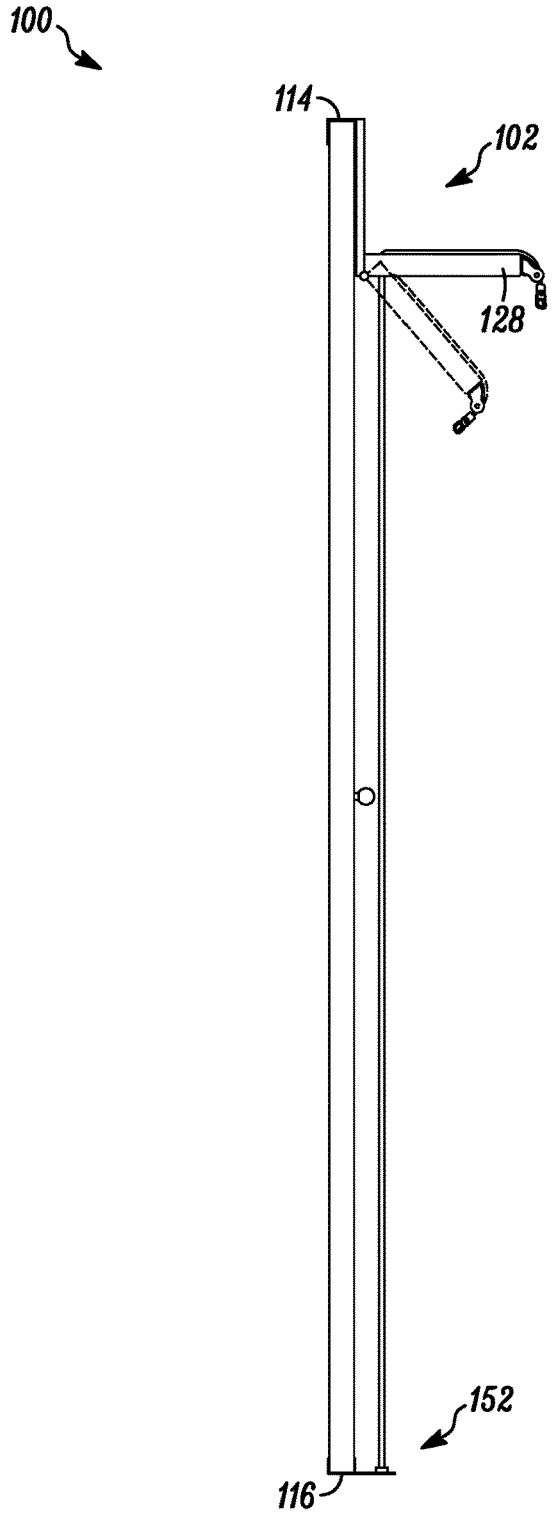
FIG. 5 is a side view of a dynamic tension traction device, according to an embodiment of the present disclosure.

FIG. 5 is a side view of a dynamic tension traction device 100. According to the embodiment of FIG. 4, extension arms 128 are coupled to arm bracket 130. Extension arm bracket 130 includes a hinge configured to selectively position extension arms 128 from an extended position to a collapsed position, as shown. Extension arms 128 are configured to an extended position when in use, and a collapsed position when not in use. Lower bracket 152 anchors resistance bands to the bottom of the door. Lower bracket 116 and upper bracket 114 hold device 100 to the lower and upper portion of the door, respectively. When extension arms 128 are configured in a collapsed position, the user can open door 10 without interference with any adjacent walls which might be present, such that device 100 may remain coupled to door 10 when not in use.

Figure 6:
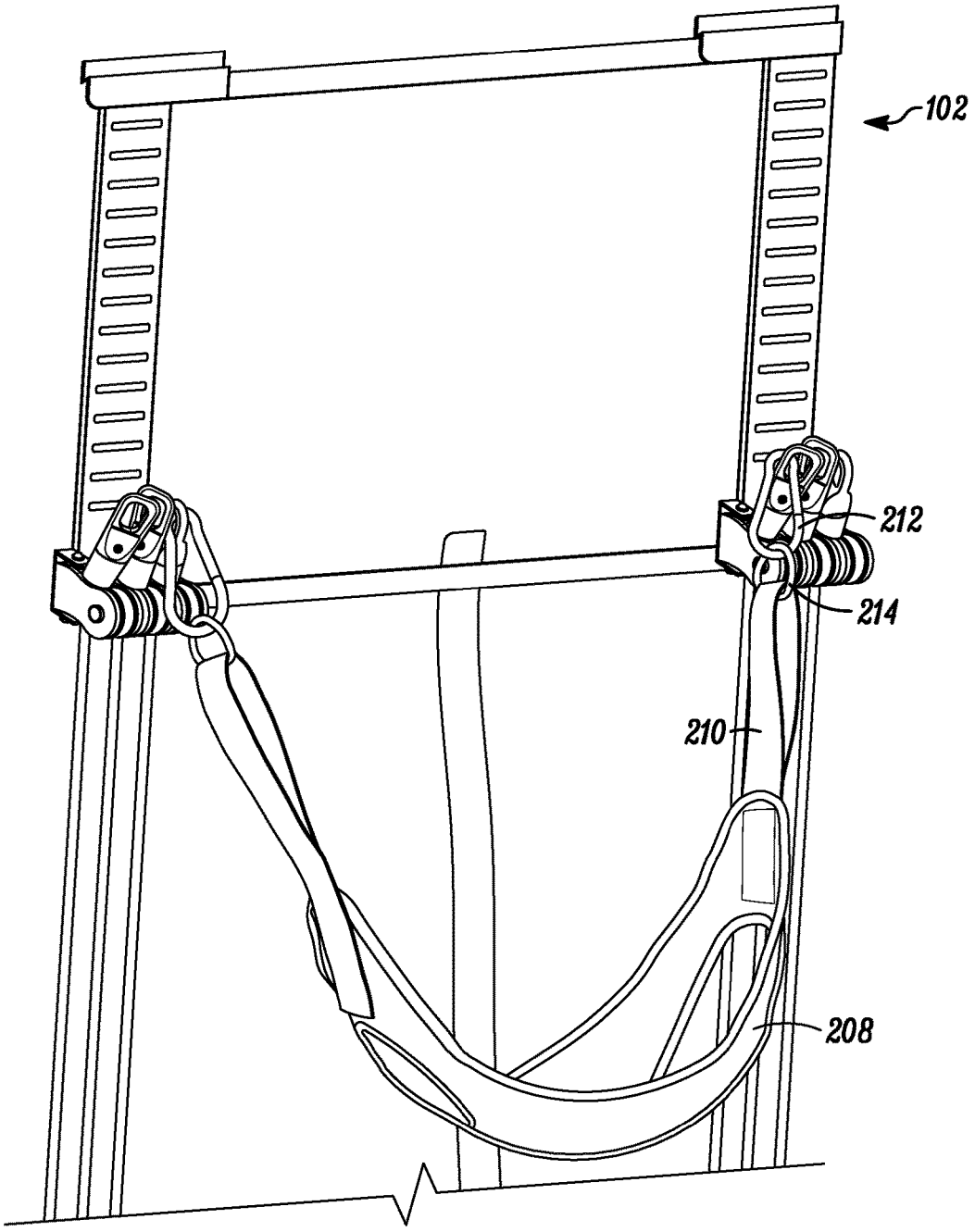
FIG. 6 is a perspective view of neck harness coupled to an upper bracket of a dynamic tension traction device, according to an embodiment of the present disclosure.

FIG. 6 is a perspective view of a neck harness or neck collar 108 coupled to an upper frame assembly 104 of dynamic tension traction device 100. According to an embodiment of the present disclosure, neck harness 108 is configured to fit around the bottom of a user's jaw and chin, extend above and around the user's ears approximately midway up both sides of the user's head, and around a lower portion of the back of the user's head. Neck harness 108 may be adjustably coupled to the user's head through the use of strapping with hook and loop fasteners, cam buckles, slide and release buckles, and the like. Neck harness 108 may further comprise harness straps 110 coupled on either side of neck harness 108. Harness straps 210 may be coupled to harness rings 214. Harness rings 214 are coupled to harness clips 212, which are removably coupled to left and right resistance band connectors 118 on either side of neck harness 108. Alternatively, harness straps 210 may be directly coupled to harness clips 212, or directly coupled to resistance band connectors 118. Harness straps 210 may be manufactured from fabric such as nylon, or make be embodied as cables or ropes. Harness straps 210 may be removably coupled to harness rings 214 (or directly to harness clips 212 or resistance band connectors 118) through the use of hook and loop fasteners, cam buckles, slide and release buckles, and the like. Neck harness 108 may be manufactured from fabric, and may further comprise padding to improve comfort to the user during use. It is anticipated that neck harness 108 may be configured as numerous alternative embodiments, including as a collar around the neck that does not extend up the side of the head. Any embodiment capable of applying cervical spine traction to the neck is an acceptable alternative.

Figure 7:
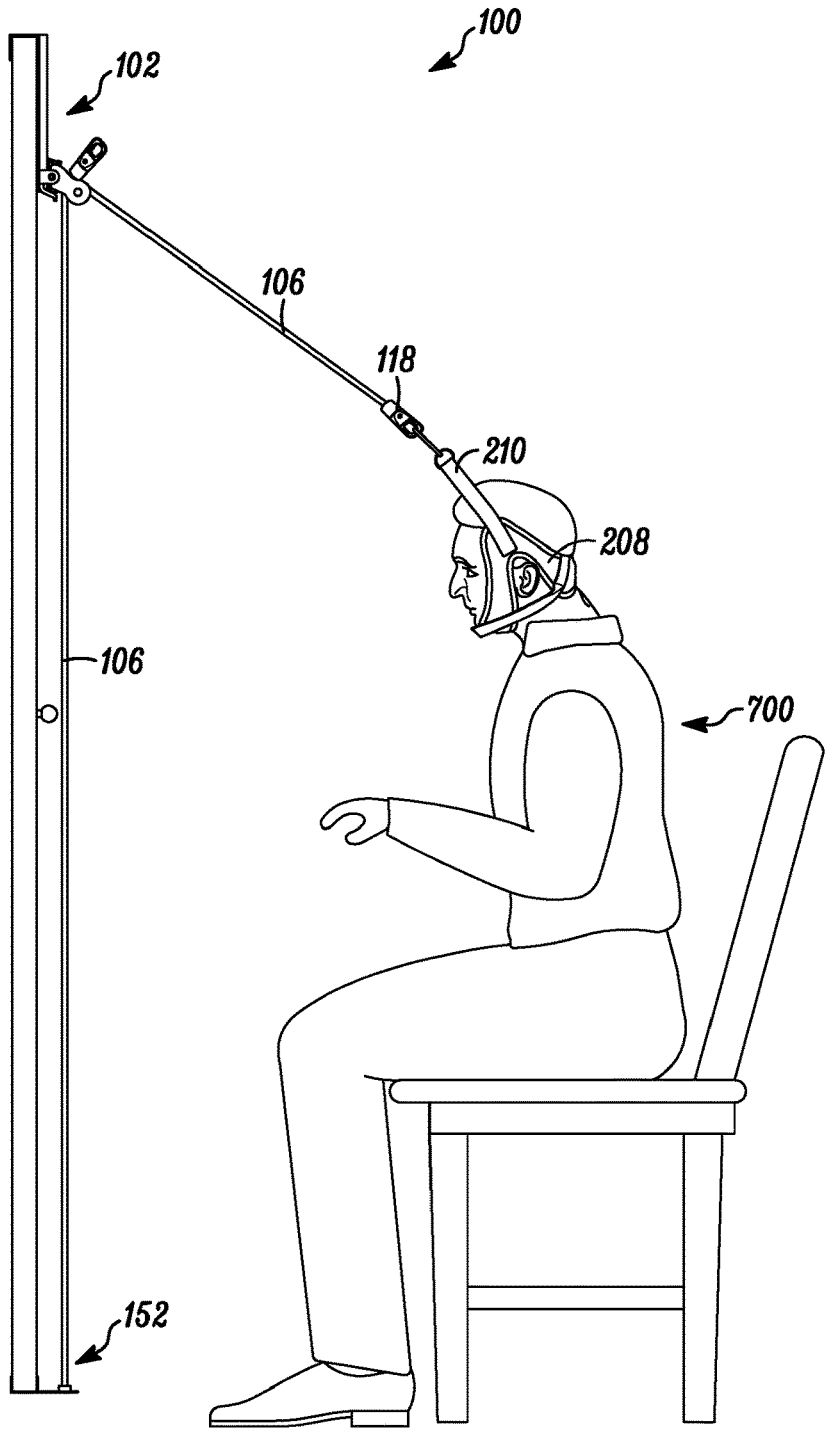
FIG. 7 is a side view of a dynamic tension traction device in use, according to an embodiment of the present disclosure.

FIG. 7 is a side view of a dynamic tension traction device 100 in use by a user 700. According to an embodiment of the present disclosure, user 700 utilizes device 100 to self-administer spinal decompression therapy in a home setting. User 700 couples neck harness 208 around user's head, as described in FIG. 6 above. Neck harness 208 is coupled to resistance bands 106 via harness straps 210 and resistance band connectors 118, as described in FIG. 6 above. In a preferred method of use, user 700 sits in a chair 702. Chair 702 is placed a desired distance away from door 10 according to the desired amount of traction force to be applied during spinal decompression therapy. The greater the distance chair 702 is placed from door 10, the greater the amount of traction force that is applied by resistance bands 106 as the user stretches resistance bands 106 during use. When user 700 sits in chair 702 with neck harness 208 coupled to user's head, user 700 stretches resistance bands 106. Alternatively, user 700 may administer spinal decompression therapy without the use of a chair, and may simply position his or her body so as to engaged resistance bands 106. As resistance bands 106 are stretched, resistance is applied to neck harness 208 and traction force is applied to the neck of user 700. Traction is passively applied to user 700, rather than actively, as user 700 moves his or her body away from door 10. As user 700 moves backward and stretches resistance bands 106, tension is incrementally exerted by the resistance bands 106 on neck harness 208, and traction is gradually applied to the user's spine. User 700 is able to move against the body's reflex of the tightening the muscles in the neck in response to lateral force by gradually moving his or her body into the traction force. This accomplishes the decompression goals of getting the muscles of the user to relax and lengthen. Since tension is gradually applied by resistance bands 106 in response to the user's body movement, user 700 is able to apply the desired amount of traction force by repositioning his or her body. User 700 can immediately reduce or increase the amount of traction according to body position. The amount of traction force can be further increased by coupling additional resistance bands 106 to the left and/or right sides of neck harness 208.

Figure 8B:
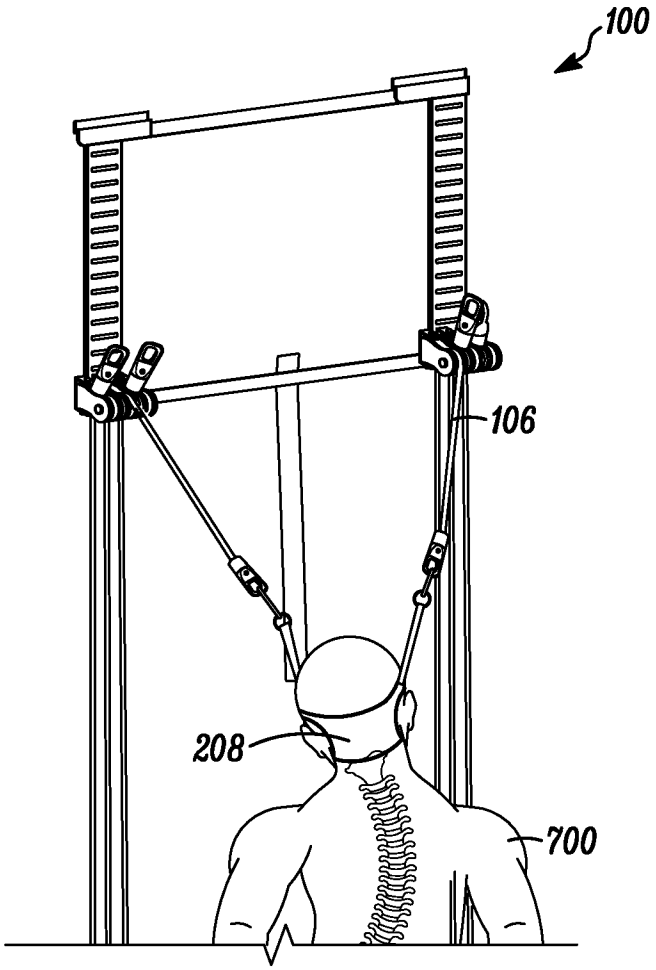
FIG. 8B is a functional view of a dynamic tension traction device in use, according to an embodiment of the present disclosure; and, FIG. 9 is a perspective view of a dynamic tension traction device, according to an embodiment of the present disclosure.
Figure 8A:
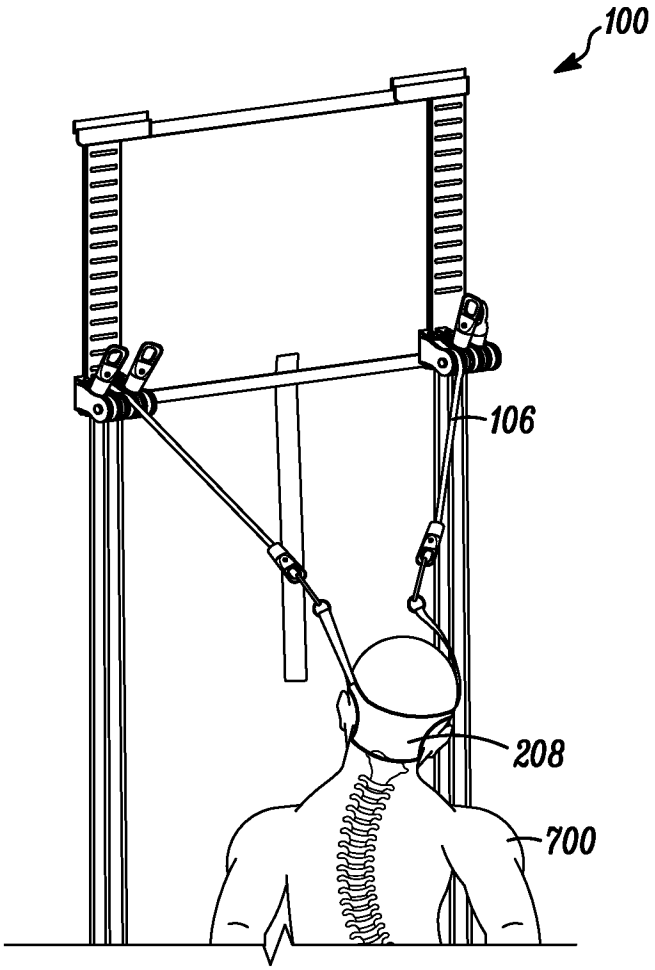
FIG. 8A is a functional view of a dynamic tension traction device in use, according to an embodiment of the present disclosure.

FIGS. 8A and 8B are functional views of a dynamic tension traction device 100 being utilized by a user 700 for spinal decompression therapy. Device 100 is configured to apply traction to user 700 in multiple force vectors according to the position of the user's body and head. Since traction is applied to user 700 via the elastic resistance force of resistance bands 106 positioned on the left side and right side of the user's body, user 700 is able to apply force in any direction in which resistance bands 106 are stretched. For example, as shown in FIG. 8A, if user 700 moves his or her head to the right, more tension is applied by resistance bands 106 on the left side of the user's body, thereby lengthening the muscles on the left side of the user's neck and applying more decompression force on the left side of the user's spine. As shown in FIG. 8B, if user 700 moves his or her head to the left, more tension is applied by resistance bands 106 on the right side of the user's body, thereby lengthening the muscles on the right side of the user's neck and applying more decompression force on the right side of the user's spine. User 700 may manipulate the vector of the traction force in any direction by moving his or her body and/or neck forwards, backwards, upwards, downwards and side-to-side.

Figure 9:
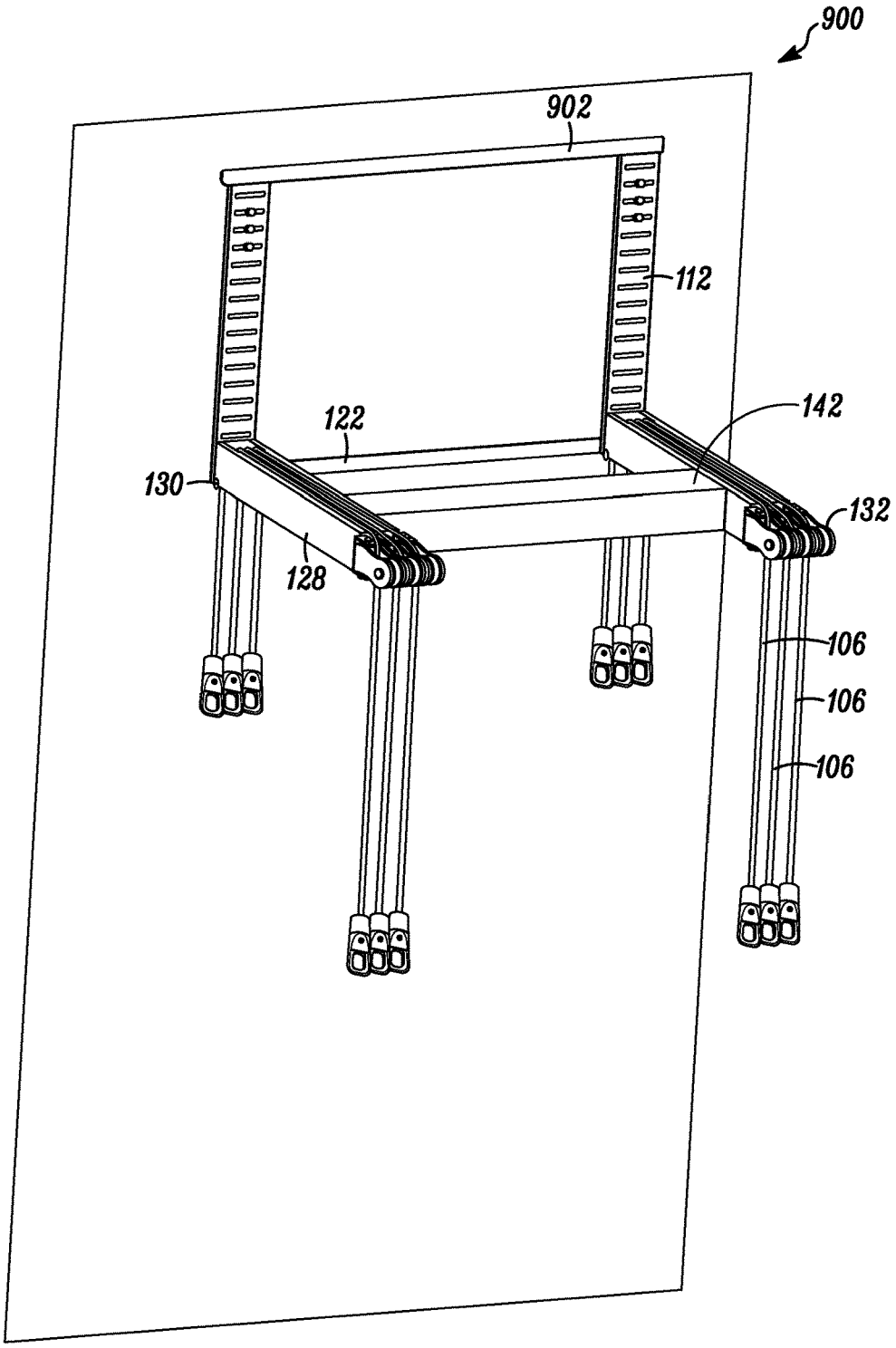

FIG. 9 is a perspective view of an alternative embodiment of dynamic tension traction device 900. According to an embodiment of the present disclosure, device 900 is generally comprised of roller tracks 112, wall support bar 902, roller support bar 122, extension arms 128, extension arm support rod 142, extension arm brackets 130, resistance bands 106, and extension arm rollers 132. Device 900 performs substantially the same function in the substantially the same way as that of device 100, as described in FIGS. 1A-8 above. Device 900, however, embodies a permanent installation to a wall. Roller tracks 112 are coupled to a wall through the use of one or more screws or bolts. The embodiment of device 900 may be utilized more frequently for hospital or medical office use, where permanent installation is more convenient than door-mounted installation, as described in FIGS. 1A-8 above.

Embodiments of the present disclosure may further comprise methods of use in which the user incorporates one or more biofeedback devices to measure and monitor the user's vital signs and/or other body functions during use of the user-actuated dynamic tension traction device. Such biofeedback devices may include heartrate monitors, body temperature monitors, respiration monitors, blood pressure monitors, and the like. According to a method of use, a biofeedback device can measure the efficacy of the user-actuated dynamic tension traction device to the user in terms of the change in the user's vital signs or other biofeedback indicators. Such biofeedback devices may further interface with a computer system to record and store biofeedback data during use, and aggregate and display such data over time to illustrate the user's progress towards improving neck and back pain.

The present disclosure includes that contained in the appended claims as well as that of the foregoing description. Although this invention has been described in its exemplary forms with a certain degree of particularity, it is understood that the present disclosure of has been made only by way of example and numerous changes in the details of construction and combination and arrangement of parts may be employed without departing from the spirit and scope of the invention.

What is claimed is:

1. A portable apparatus for spinal decompression therapy, comprising:

a first frame assembly, the first frame assembly having an attachment means configured to selectively couple to a bottom portion of a door;

a second frame assembly, the second frame assembly having an attachment means configured to selectively couple to a top portion of a door;

at least one first resistance band having a first end and a second end, the first end of the at least one first resistance band being removably coupled to a right-side portion of the first frame assembly, and the second end of the at least one first resistance band being removably coupled to a right-side portion of the second frame assembly;

at least one second resistance band having a first end and a second end, the first end of the at least one second resistance band being removably coupled to a left-side portion of the first support frame, and the second end of the at least one first resistance band being removably coupled to a left-side portion of the second support frame; and, a neck collar having a first attachment means selectively attached to the at least one first resistance band, and a second attachment means selectively attached to the at least one second resistance band, the collar being configured to be selectively coupled around the head of a user.

2. The apparatus of claim 1 further comprising a resistance band support bar coupled to the second frame assembly, the resistance band support bar having at least one first roller and at least one second roller.

3. The apparatus of claim 2 further comprising a roller track for adjusting the height of the resistance band support bar on the second frame assembly.

4. The apparatus of claim 2 further comprising an attachment means coupled to the first end and the second end of the at least one first resistance band and the at least one second resistance band.

5. The apparatus of claim 2 wherein the at least one first resistance band is engaged with the at least one first roller, and the at least one second resistance band is engaged with the at least one second roller.

6. The apparatus of claim 2 further comprising two or more resistance bands selectively coupled to the first frame assembly and the second frame assembly.

7. The apparatus of claim 6 wherein the collar is selectively attached to one or more of the two or more resistance bands according to the desired resistance.

8. The apparatus of claim 1 wherein the at least one first resistance band and the at least one second resistance band are made from a material selected from the group consisting of elastic, rubber, rubber synthetic, elastic synthetic, rubber composite, and elastic composite.

9. The apparatus of claim 1 wherein the at least one first resistance band and the at least one second resistance band are operable to apply resistance to the collar in a 360 degree range of motion in response to the positioning of the user.

10. A portable apparatus for spinal decompression therapy, comprising:

a first frame assembly, the first frame assembly having an attachment means configured to selectively couple to a bottom portion of a door;

a second frame assembly, the second frame assembly having an attachment means configured to selectively couple to a top portion of a door;

a first support arm pivotably coupled to the second frame assembly;

a second support arm pivotably coupled to the second frame assembly;

at least one first resistance band having a first end and a second end, the first end of the at least one first resistance band being removably coupled to a right-side portion of the first frame assembly, and the second end of the at least one first resistance band being removably coupled to a right-side portion of the second frame assembly and the first frame assembly;

at least one second resistance band having a first end and a second end, the first end of the at least one second resistance band being removably coupled to a left-side portion of the first frame assembly, and the second end of the at least one first resistance band being removably coupled to a left-side portion of the second frame assembly and the second support arm; and, a collar having a first cable selectively attached to the at least one first resistance band, and a second cable selectively attached to the at least one second resistance band, the collar being configured to be selectively coupled to the neck of a user.

11. The apparatus of claim 10 further comprising a locking means for configuring the first support arm and the second support arm from a collapsed position to an extended position.

12. The apparatus of claim 11 further comprising a resistance band support bar coupled to the second frame assembly, the resistance band support bar having at least one first roller and at least one second roller.

13. The apparatus of claim 12 further comprising at least one roller coupled to the first support arm and the second support arm.

14. The apparatus of claim 13 wherein the at least one first resistance band and the at least one second resistance band are operably engaged with the at least one first roller and at least one second roller.

15. The apparatus of claim 13 further comprising two or more resistance bands selectively coupled to the first frame assembly and the second frame assembly.

16. The apparatus of claim 12 further comprising a locking means for adjusting the height of the resistance band support bar on the second frame assembly.

* * * * *